United States Patent [19]

Richey

[11] Patent Number: 4,481,068

[45] Date of Patent: Nov. 6, 1984

[54] SELECTIVE SPOT GLUE SYSTEM

[75] Inventor: Jarold L. Richey, Dayton, Ohio

[73] Assignee: Harris Graphics Corporation, Melbourne, Fla.

[21] Appl. No.: 563,331

[22] Filed: Dec. 20, 1983

[51] Int. Cl.[3] ..... D05C 1/16

[52] U.S. Cl. ..... 156/548; 118/211; 118/221; 118/253; 270/52

[58] Field of Search ..... 156/578, 291, 548; 118/211, 221, 253; 270/52, 53

[56] References Cited

U.S. PATENT DOCUMENTS

| | | | |
|---|---|---|---|
| 2,029,922 | 2/1936 | Heckel et al. | 118/253 X |
| 2,371,871 | 3/1945 | Burckhardt | 118/253 X |
| 2,674,225 | 4/1954 | Burke et al. | 118/211 X |
| 3,196,065 | 7/1965 | Lisgewski et al. | 156/548 X |
| 3,476,631 | 11/1969 | Huffman | 156/291 |
| 3,727,576 | 4/1973 | Schriber | 118/221 X |
| 4,082,059 | 4/1978 | McFatyre et al. | 118/253 X |
| 4,426,072 | 1/1984 | Cole et al. | 270/53 |

*Primary Examiner*—David Simmons

*Attorney, Agent, or Firm*—Biebel, French & Nauman

[57] ABSTRACT

A machine for collating multiple flexible webs includes a power driven conveyor on which the webs are assembled, a plurality of wheel members to guide the webs onto the conveyor, and glue nozzles mounted opposite certain of the wheel members to deposit glue onto a selected area of a web passing around the associated wheel member. A spot glueing attachment is provided for the wheel members in the form of an integral flexible member having a pair of curved side parts spaced apart to fit against opposite sides of the wheel member and having an outer diameter approximately equal to the diameter of the wheel. Cross bars connect the side parts and extend across the periphery of the wheel. Studs on the attachment fit into holes in the wheel, allowing mounting and removal of the attachment without use of tools.

6 Claims, 7 Drawing Figures

SELECTIVE SPOT GLUE SYSTEM

BACKGROUND OF THE INVENTION

1. Field of the Invention

The present invention relates to glue applicators for collating machines or the like, and more particularly, to a spot glueing attachment for glue applicators utilizing glue nozzles which contact at least one moving web.

2. Prior Art

Collating machines, such as that disclosed in U.S. Pat. No. 3,682,468 issued to the predecessor of applicant's assignee, are used to fabricate multi-part business forms comprising a plurality of sheets glued together, typically at their longitudinal edges. Such machines include horizontally spaced spindles on which are mounted paper supply rolls and power driven feed wheels around which webs from the paper supply rolls are threaded to be collected in over-lapping relation for example along a pin conveyor. Those feed wheels or rollers located adjacent the conveyor, also function to back up the web as glue is applied to the web, for example by a glue application system disclosed in U.S. application Ser. No. 259,120 filed Apr. 30, 1981, now U.S. Pat. No. 4,426,072.

The basic elements of such systems are one or more glue nozzles, a source of glue, a supply line connecting the nozzles with the source of glue, and a valve which can be opened and closed to start and stop the glow of glue through each nozzle. Each nozzle is directed toward a moving web passing around a feed roller prior to the web engaging the pin conveyor. In the usual arrangement there are two wheels, and nozzles corresponding to each, for each paper web, less one. There may be intermediate carbon webs, but ordinarily these are not glued. At least the wheels and nozzles on the operator side of the machine are transversely adjustable to accommodate different widths of forms.

SUMMARY OF THE INVENTION

The present invention is directed to an improved glue application system for a collating machine or the like, utilizing such nozzles and feed/glue wheels which retain the capability of producing a thin, uniform glue line on a moving web, and also can alternatively place regularly spaced spots of glue on the webs when it is desired to manufacture spot glued forms.

The invention provides a simple attachment for the feed/glue wheels in the form of a ladder-like member, preferably flexible, which can quickly be fitted to the wheels. Cross bars on these members provide spaced peripheral additions to the periphery of the wheels. As a web passes around the attachment, parts of the web are pushed out from the periphery of the wheel itself. The nozzles are then adjusted so they will contact the web only where the cross bars are located, thereby placing spaced spots of glue on the web.

The primary object of the invention, therefore, is to provide a novel spot glueing attachment device for the glue system of a collating machine, or the like; to provide such attachment in the form of a member which can be fitted over the glue wheels of the machine and function to raise portions of a web away from the wheel at regular intervals, whereby glue can be applied from the nozzles only to such portions; to provide such an attachment in the form of a flexible ladder-like member having cross bars which are located in spaced locations around the periphery of the wheel to perform this function; and to provide such an attachment as an integral molded member that can be quickly fitted to and removed from the glue wheels without need of tools.

These and other objects of the invention will become apparent from the following description, the attached drawings, and the appended claims.

DETAILED DESCRIPTION OF THE PREFERRED EMBODIMENT

Figure 1:
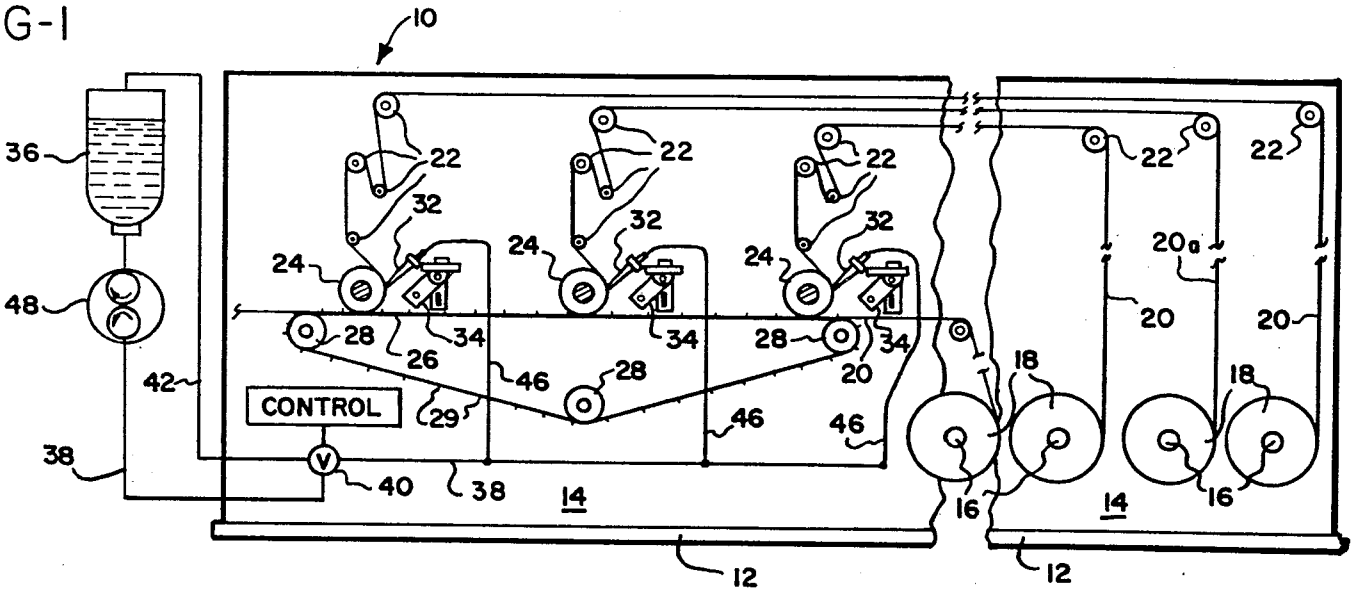
FIG. 1 is a schematic side view of a typical collator incorporating a glue system according to the present invention.

As shown in FIG. 1, a spot glue attachment according to the present invention can be applied to a collating apparatus 10, as more fully described in above mentioned U.S. Pat. No. 3,682,468. However, it should be understood the invention is also applicable to other types of apparatus having a collating function. The collating apparatus 10 includes an elongated base 12 from which extends a vertical frame or wall 14. A series of horizontally arranged parallel spindles 16 are supported extending outwardly from the wall 14 for free rotation and receive corresponding rolls 18 of paper webs 20 (only two shown), each having longitudinally spaced marginal perforations or feed holes, and (if desired) intermediate carbon tissue web 20*a* (only one shown). Typically, the webs are directed by a series of spindles 22 to corresponding feed or glue wheels 24, which are mounted for adjustment lengthwise of rotatable shafts 25 positioned above an endless pin conveyor 26 carried by pulleys 28, and advanced right to left as viewed in FIG. 1 by a suitable drive (not shown). The same drive rotates shafts 25, which in turn rotate wheels 24 at a speed which matches the peripheral speed of the wheels to the conveyor speed.

The pin conveyor 26 is fitted with a series of protrusions or pins 29 spaced apart to engage through the feed holes of the paper webs 20, and into slots 30 in the wheels 24. The rotatable spindles 22, shafts 25, and pulleys 28 are cantilevered outwardly from the wall 14 of the collating apparatus 10. Movement of the pin conveyor 26 and feed rollers 24 causes the webs 20 to move along the pin conveyor and collect in overlapping relationship.

The glue application system includes a series of nozzles 32 mounted on positioning means 34 which is supported on to wall 14. The nozzles 32 are supplied with glue from a reservoir 36 via conduit 38. A three-way valve 40, in conduit 38, also connects with reservoir 36 by way of a return line 42, and is operated by a suitable control 43. The conduit 38 in turn supplies feed lines 46 which extend to the nozzles 32. A positive displacement pump 48 feeds glue from the reservoir to supply line 38.

Figure 2:
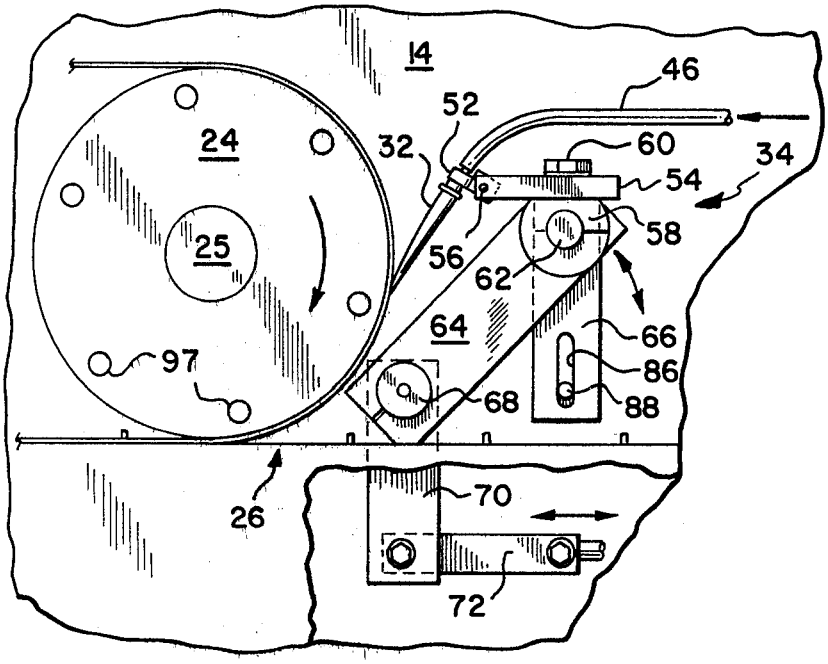
FIG. 2 is an enlarged partial side view of a glue nozzle operating on a web backed by a feed/glue wheel which may be fitted with a spot glueing attachment.

As shown in FIG. 2 a nozzle 32 is joined to a feed line 46 at a mounting bracket 52, which is clamped to a support bar 54 by a bolt 56, allowing the mounting bracket and nozzle 32 to be positioned at different angles to the support bar. Bar 54 is held to a collar 58 by a bolt 60 extending through a longitudinal slot 61 formed in the support bar 54, to allow the support bar to be adjusted (left to right) relative to the collar 58. Collar 58 is clamped around a rod 62 which is parallel to the adjacent shaft 25 and feed rollers 24, thereby allowing movement of the nozzle 32 toward and away from wheels 24. Collars 58 are adjustable along the rods 62 and can be positioned corresponding to different spacings of the wheels to accommodate webs of varying widths.

Rod 62 passes through an end of an arm 64 and is rigidly mounted in an end of a lever 66 adjacent the end of the arm on a side opposite the collar 58. The opposite end of the arm 64 has an opening which holds a pin 68 which passes through the wall 14 of the collating apparatus 10. On the opposite side of the wall 14 the pin is rigidly mounted to an end of a second arm 70. Arm 70 is connected by a linkage 72 to the rod 74 of a double-acting cylinder (not shown) as explained in aforementioned U.S. Pat. No. 4,426,072. Lever 66 has a longitudinal slot 86 fitted over a dowel 88 which preferably is press fitted into the wall 14, such that lever 66 moves relative to the dowel within limits defined by the slot.

Figure 3:
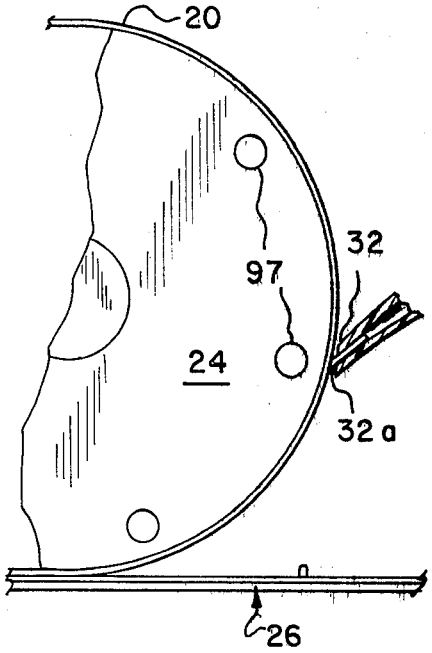
FIG. 3 shows greater detail of the web/nozzle interface.

To retract a nozzle 34 from wheel 24, rod 74 moves linkage 72 and causes the arm 70 to rotate pin 68. This rotates arm 64 about the axis of the pin and draws the nozzle 32 away from wheel 24. At the same time, arm 64 causes lever 66 to rotate about dowel 88. Since the distance from dowel 88 to rod 62 is less than the distance from the rod to the pin 68, rotation of arm 64 rotates lever 66 to a greater extent. Thus, nozzle 32 is rotated so its end points upward to a greater degree than if the rod was rigidly mounted to the arm 64. Further details of a suitable nozzle, and of the operation of the nozzles' mounting and control are described in said U.S. Pat. No. 4,426,072. Nozzles 32 preferably are of a flexible construction, and include a tip 32*a* which is pressed against the web as shown in FIG. 3.

In accordance with the present invention, an attachment device 90 is provided which can easily be fastened, without use of tools, to the feed/glue wheels 24 as may be appropriate. It should be understood that in a typical collating machine, in order to produce a four-part form it is necessary to glue three of the webs making up this form, thus appropriate attachments as herein described must be fitted to each of six of these wheels. It is desirable that this task be accomplished quickly and easily, preferably without use of tools, and that the attachment parts be of such nature that they can be readily available, easily handled, and not easily misplaced, damaged or destroyed.

Figure 4:
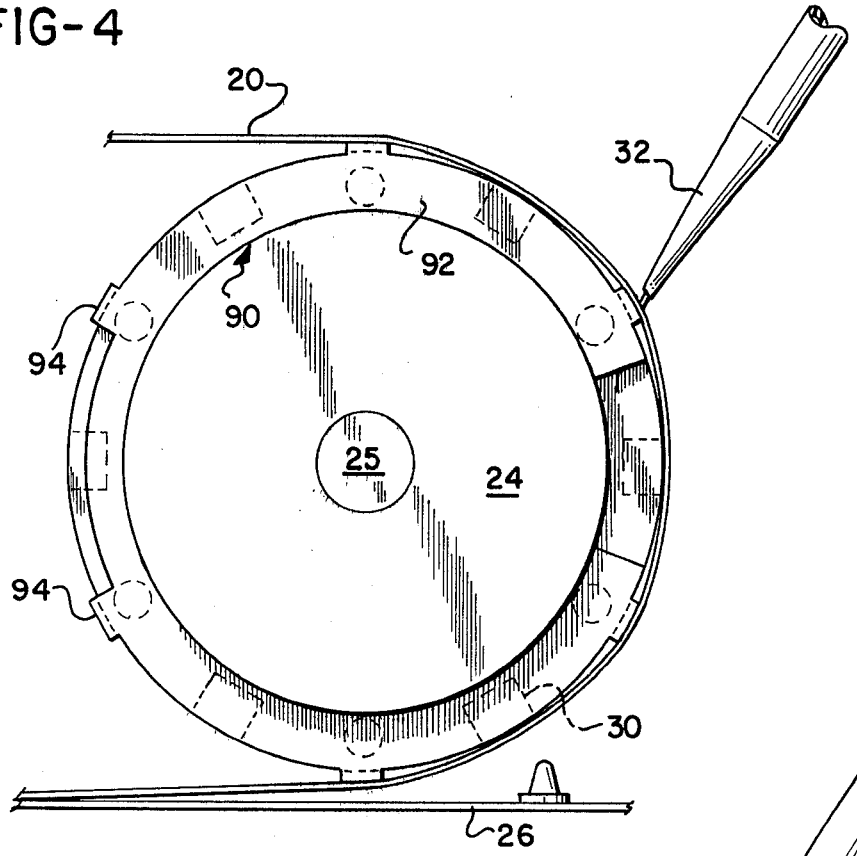
FIGS. 4 and 5 are progressive side views similar to FIG. 2 showing a spot glueing attachment and a glue nozzle engaged and disengaged with a web.

Therefore, in accordance with the invention the attachment 90 is provided in the form of a molded somewhat flexible part shaped to have two sides 92 that fit around the edges of the wheel 24, and a series of spaced apart cross bars 94 joining the two side parts and preferably integrally molded thereto. The construction and dimensions of the attachment 90 are such that the side parts or 92 are of a diameter and circumferential shape matching the periphery of the wheel 24, and the cross bars 94 thus rest across the periphery of the wheel as shown in FIGS. 3 and 4. It will be noted that the attachment is in the form of an incomplete circle, and being flexible it can be spread apart to slip around and formed to the cylindrical outer configuration of the wheel. At the ends of the attachment, there are inwardly extending studs 95 that can fit or snap into appropriate holes 97 within the peripheral sides of the wheel 24. These are located with respect to the cross bars such that the cross bars are located between the slots 30 in the wheel. For threading (makeready) the pin conveyor can be lowered a small amount, about one-eighth inch in practice. The relieved portions 98 in the sides 92 provide adequate clearance to permit slipping one side of the attachment between a pin on the conveyor and the edge of the wheel.

Figure 5:
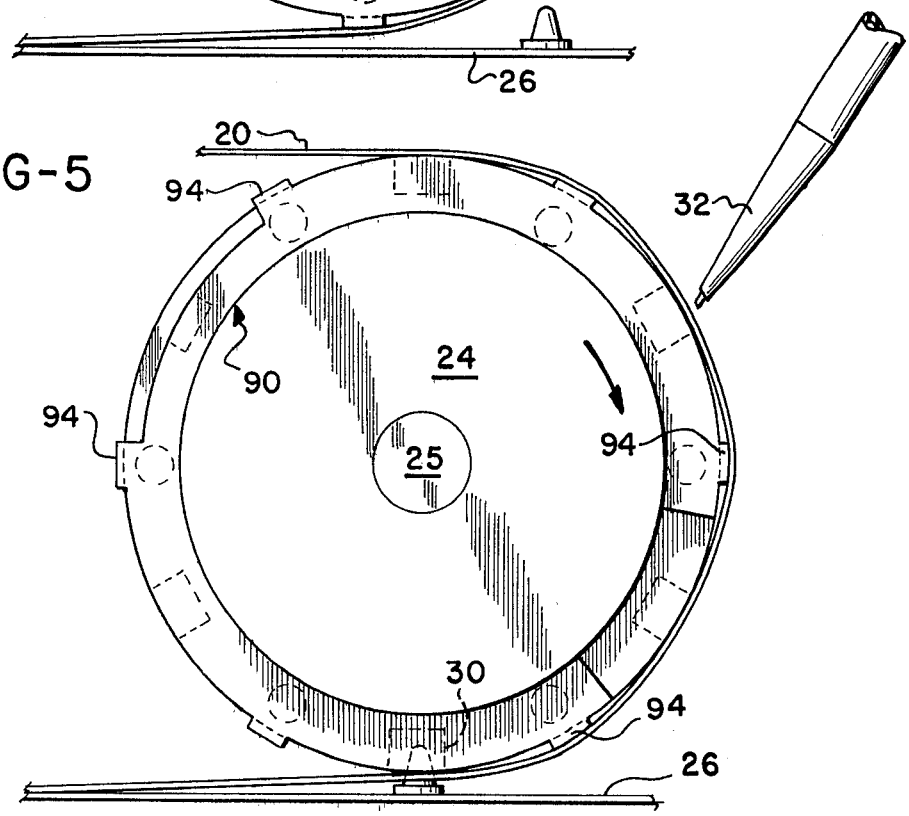
Figure 6:
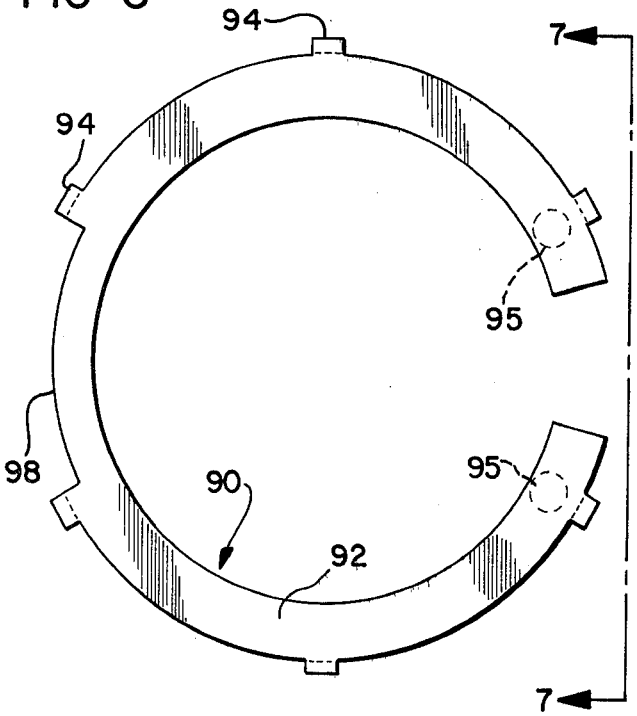
FIG. 6 is a side view of the spot glueing attachment itself.
Figure 7:
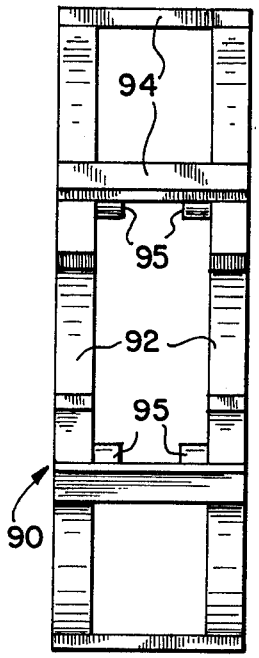
FIG. 7 is an end view taken along line 6—6 of FIG. 6.

Thus, with the attachment 90 in place the web contacts the outer surface of the cross bars 94 as the wheels 24 rotate to assist in feeding the web to the pin conveyor 26. In so doing, the web is displaced from a circular path and extends essentially from one cross bar to the next, as shown in FIGS. 4 and 5, whereby regularly spaced portions of the web are displaced radially outward from the axis of rotation of wheel 24. The nozzles are then adjusted by the above described mechanism such that the tips of the nozzles contact only these outwardly displaced portions of the web, thereby depositing a spot of glue on these portions, while the intermediate portions of the web move along a path of lesser radial distance from the axis of the wheel, and are therefore out of contact with the nozzle tip. The result is a regularly spaced series of glue spots on the web, as is desired.

As can readily be appreciated, the preferred embodiment of the attachment, being an integrally molded flexible piece, of polyurethane for example, is relatively inexpensive to manufacture, and thus not particularly expensive to replace if lost or damaged. It can be attached to the feed/glue wheels 24 by hand, quite easily as above described, and thus provides an effective attachment to convert the continuous glueing arrangements into spot glue systems within a matter of a very few minutes. Since any such change over is part of the makeready process of the machine, it is unproductive time, and minimizing such time in utilization of expensive trained labor is a useful result.

While the apparatus herein described constitute preferred embodiments of the invention, it is to be understood that the invention is not limited to these precise methods and forms of apparatus and that changes may be made in either without departing from the scope of the invention.

What is claimed is:

1. In a machine for collating multiple flexible webs, including a power driven conveyor on which the webs are assembled, a plurality of wheel members arranged to guide individual webs onto the conveyor, glue nozzles mounted opposite certain of the wheel members and operative to deposit glue onto a selected area of a web passing around the associated wheel member; the improvement comprising a spot glueing attachment for the wheel members including a pair of curved side parts spaced apart to fit against opposite sides of the wheel member and having an outer diameter approximately equal to the diameter of the wheel, cross bars connecting said side parts and designed to extend across the periphery of the wheel, and means for securing said attachment to a selected wheel member.

2. An attachment as defined in claim 1, wherein said side parts and said cross bars are an integral member.

3. An attachment as defined in claim 2, wherein said side parts are discontinuous partially circular members.

4. An attachment as defined in claim 3, wherein said said parts and cross members are an integral molded part of flexible solid plastic material.

5. An attachment as defined in claim 1, wherein said cross bars are regularly spaced around said side parts and occupy a small portion of the periphery thereof.

6. An attachment as defined in claim 5, wherein said securing means are stud members extending from each of said said parts toward the other so as to engage in mating holes in the sides of the wheels.

* * * * *